US007391378B2

(12) United States Patent
Mikkola et al.

(10) Patent No.: US 7,391,378 B2
(45) Date of Patent: Jun. 24, 2008

(54) ANTENNA ELEMENT FOR A RADIO DEVICE

(75) Inventors: Jyrki Mikkola, Kaustinen (FI); Petteri Annamaa, Oulunsalo (FI); Esa Kalistaja, Oulu (FI)

(73) Assignees: Filtronic LK Oy, Kempele (FI); LK Products Oy, Kempele (FI); Pulse Finland Oy, Kempele (FI)

( * ) Notice: Subject to any disclaimer, the term of this patent is extended or adjusted under 35 U.S.C. 154(b) by 464 days.

(21) Appl. No.: 10/753,887

(22) Filed: Jan. 7, 2004

(65) Prior Publication Data

US 2004/0147297 A1 Jul. 29, 2004

(30) Foreign Application Priority Data

Jan. 15, 2003 (FI) ..... 20030059
Feb. 7, 2003 (FI) ..... 20030193

(51) Int. Cl.
*H01Q 1/24* (2006.01)
*H01Q 1/40* (2006.01)

(52) U.S. Cl. ..... 343/702; 343/872; 343/873

(58) Field of Classification Search ..... 343/702, 343/872, 873
See application file for complete search history.

(56) References Cited

U.S. PATENT DOCUMENTS 5,017,932 A 5/1991 Ushiyama et al.
6,603,430 B1 * 8/2003 Hill et al. ..... 343/702

FOREIGN PATENT DOCUMENTS

EP 0 851 530 A2 7/1998
EP 0 923 158 A2 6/1999
EP 1 067 627 A1 1/2001

(Continued)

OTHER PUBLICATIONS

A Finnish Search Report, dated Sep. 26, 2003, which issued during the prosecution of Finnish Application No. 20030193 which corresponds to the present application.

(Continued)

*Primary Examiner*—Tan Ho
(74) *Attorney, Agent, or Firm*—Darby & Darby P.C.

(57) ABSTRACT

A radiating antenna element intended to be used in small-sized radio devices, and a radio device having an antenna element according to the invention. The antenna element is part of the covers of a radio device. The antenna element may be conductive throughout, or it may comprise a dielectric portion and a conductive portion, which constitute a single integral component. The radiating portion of the antenna element is relatively large, e.g. in a foldable phone (20) the antenna element (200) may comprise the whole cover of a foldable part (21) except for the front side. The radiating element is advantageously fed electromagnetically through a feed element. As the radiating element is relatively large and is located on the outer surface of the device, the radiation characteristics of the antenna are good, and the space required by the antenna inside the device is relatively small.

(Continued)

17 Claims, 5 Drawing Sheets

U.S. PATENT DOCUMENTS

| | | | | |
|---|---|---|---|---|
| 6,670,926 | B2 * | 12/2003 | Miyasaka | 343/702 |
| 6,677,903 | B2 * | 1/2004 | Wang | 343/702 |
| 6,806,835 | B2 * | 10/2004 | Iwai et al. | 343/702 |
| 6,950,068 | B2 * | 9/2005 | Bordi et al. | 343/702 |
| 2002/0113741 | A1 * | 8/2002 | Asano et al. | 343/702 |

FOREIGN PATENT DOCUMENTS

| | | | |
|---|---|---|---|
| EP | 1 248 316 | A2 | 10/2002 |
| JP | 2001326513 | A1 | 5/2000 |

OTHER PUBLICATIONS

A Finnish Search Report, dated Sep. 18, 2003, which issued during the prosecution of Finnish Application No. 20030059 which corresponds to the present application.

European Office Action, May 30, 2005 issued during prosecution of EP 04 396 001.2-1248.

* cited by examiner

ANTENNA ELEMENT FOR A RADIO DEVICE

The invention relates to a radiating antenna element intended to be used in small-sized radio devices in particular. The invention also relates to a radio device having an antenna element according to the invention.

BACKGROUND OF THE INVENTION

In antenna design, the space available is an important factor. It is relatively easy to make an antenna of good quality if there are no size limitations. In small-sized radio devices, such as mobile phones, an antenna which protrudes outside the covers of the device is tried to be avoided, for convenience. This means that as the devices become smaller and smaller, the space available for the antenna becomes smaller, too, making antenna design even more challenging.

Internal antennas in mobile terminals usually have planar structures: The antenna comprises a radiating plane and a ground plane parallel thereto. The electrical characteristics of a planar antenna, such as bandwidth and antenna gain, depend on the distance between said planes, among other things. As mobile terminals become smaller in the direction of thickness, too, this distance inevitably becomes shorter, whereby the electrical characteristics become worse. Particularly this problem concerns foldable mobile phone models, as their folding parts are relatively flat and thin. Therefore, antennas in foldable models are in practice protruding antennas.

Available space can be used more efficiently in a radio device by fabricating the radiating element of the antenna within the cover of the device or as part of the cover, which is known as such. FIG. 1 shows an example of a radiating antenna element known from application FI20012219 which element is intended to be part of a cover of the radio device. Strictly speaking the planar bottom 110 of the antenna element 100 and its curved rim 120 are included in the cover of the device. The rim is found on three sides of the bottom, corresponding to an end of the radio device and the side surfaces at that end. When mounted, the element 100 is a radiating element in a planar inverted F antenna (PIFA), where an antenna feed conductor and short-circuit conductor are connected to the element. Antenna feed point 101 and short-circuit point 102 are marked as broken-line circles on the bottom 110. When the antenna element 100 is pressed into its place in the radio device the feed and short-circuit conductors make galvanic contact with points 101 and 102. Starting from the edge of the element 100 there is a slot 105 which makes a rectangular turn such that the element, viewed from the short-circuit point 102, is divided into two branches of different lengths. The antenna is thus a dual-band antenna. On both sides of the portion of the slot 105 which starts from the edge of the element there is a capacitance plate perpendicular to the bottom. A first capacitance plate 131 is located at the electrically outermost end of the longer branch of the element, and a second capacitance plate 132 at the electrically outermost end of the shorter branch. Both the mutual capacitance of the capacitance plates and their capacitances with the ground plane (not shown) increase the electrical lengths of the radiating branches. This reduces the size of an antenna operating in particular frequency bands. Furthermore, the antenna element 100 includes, protruding from the surface of the bottom 110, a support leg 141 and a ridge 142 which resembles a wide U and adds to the mechanical strength of the antenna element. For attachment of the antenna element it further comprises locking parts 151 and 152. All parts may be included in a single extrusion piece.

A disadvantage of the element shown in FIG. 1 is that its parts have to have certain electrical sizes, which limits the design of the element. Moreover, the characteristics of the antenna using the element may be inadequate in flat and thin radio devices.

SUMMARY OF THE INVENTION

An object of the invention is to reduce said disadvantages associated with the prior art. An antenna element according to the invention is characterized in that which is specified in the independent claim 1. A radio device according to the invention is characterized in that which is specified in the independent claim 17. Some preferred embodiments of the invention are specified in the other claims.

The basic idea of the invention is as follows: A radiating antenna element is part of the covers of a radio device. The antenna element may be conductive throughout or it may comprise a dielectric portion and conductive portion, which together constitute a single component. The radiating part of the antenna element is relatively large: in a foldable phone, for example, it advantageously comprises the whole cover of one folding part with the exception of the front side. The radiating element is fed electromagnetically through a feed element or galvanically.

An advantage of the invention is that a cover element of a radio device, which is required in any case, can be used as a radiator. Another advantage of the invention is that as the radiating element is relatively large and is located on the outer surface of the device, the radiation characteristics of the antenna are better than those of a radiator located more internally in the device. A further advantage of the invention is that the space reserved by the antenna within the device is smaller than in corresponding prior-art antennas. A further advantage of the invention is that it reduces the production costs of the radio device.

BRIEF DESCRIPTION OF THE DRAWINGS

The invention will be now described in detail. Reference will be made to the accompanying drawings in which.

DETAILED DESCRIPTION OF THE INVENTION

Figure 1:
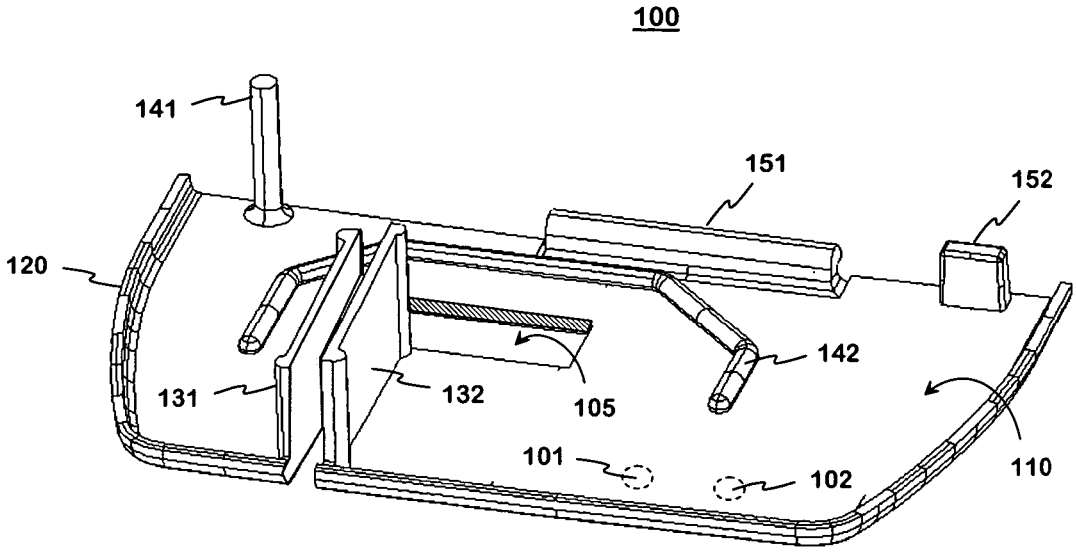
FIG. 1 PRIOR ART
FIG. 1 shows an example of an antenna element according to the prior art, FIGS. 2*a,b* show an example of an antenna element according to the invention, FIGS. 3*a,b* show a second example of an antenna element according to the invention, FIGS. 4*a,b* show a third example of an antenna element according to the invention.
Figure 2A:
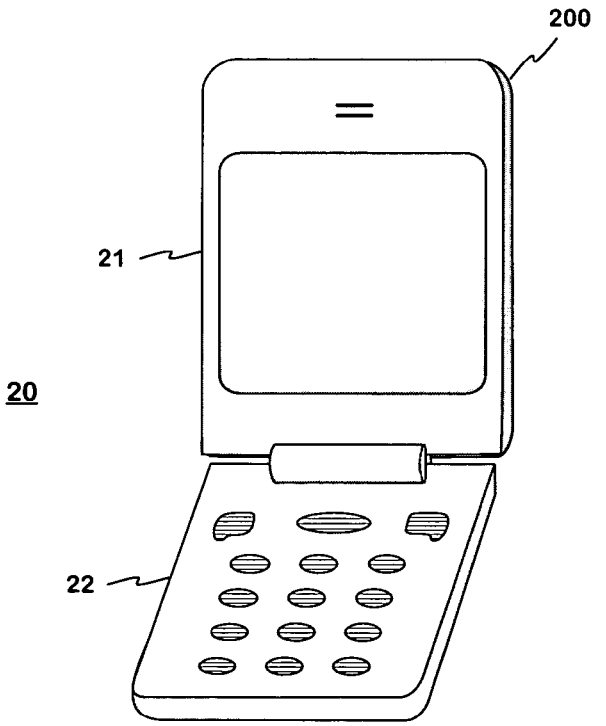
Figure 2B:
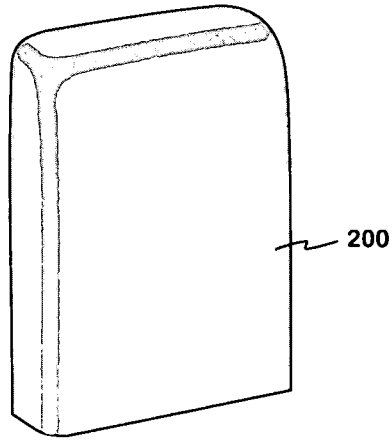

FIGS. 2*a* and 2*b* show an example of a radiating antenna element according to the invention. The antenna element 200 belongs to a radio device depicted in FIG. 2*a* which in this example is a foldable communication device 20. The communication device has a first part 21 and a second part 22 which can be turned with respect to one another around a hinge located between them. FIG. 2*b* shows just the antenna element 200. This is a single conductive piece constituting the back side and relatively narrow lateral sides and the upper end side of the cover of the first part 21. It may be made of aluminum by extruding, for example. The size of the antenna element is not bound to the wavelength corresponding to an operating frequency. The element is large compared to a quarter of the wavelength, enabling good radiation and receive characteristics. The location of the radiator on the outer surface of the radio device has the same effect. In the end product, the antenna element 200 as well as the antenna elements of FIGS. 3 to 7 and 9 to 10 are naturally coated with a thin protective layer.

Figure 3A:
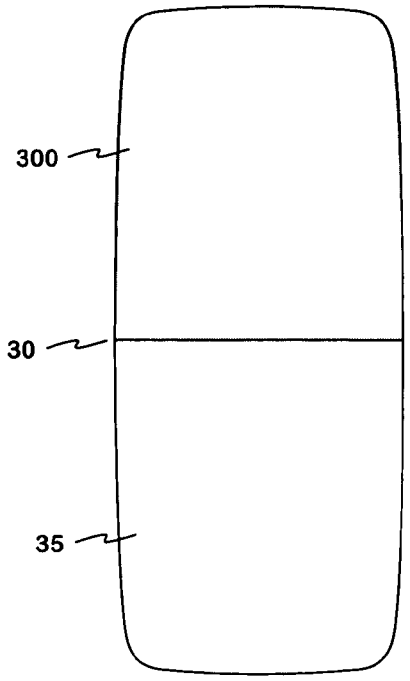
Figure 3B:
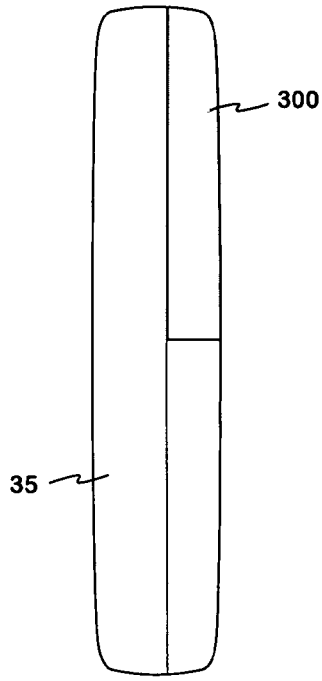

FIGS. 3*a* and 3*b* show a second example of a radiating antenna element according to the invention. The antenna element 300 belongs to a radio device 30 which in this example is an ordinary non-foldable mobile communication device. In FIG. 3*a* the communication device is seen from behind and in FIG. 3*b* from a side. The antenna element 300 is a single conductive piece forming about one half of the back side of the cover of the communication device 30, extending to the lateral sides and end side, too. The element 300 connects to the rest 35 of the cover of the radio device without any discontinuity of the outer surface.

Figure 4A:
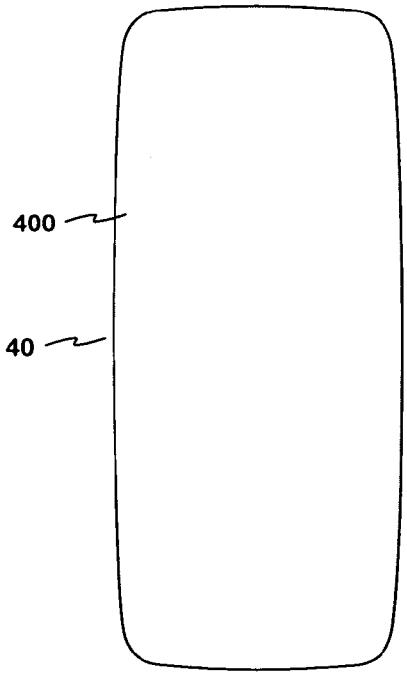
Figure 4B:
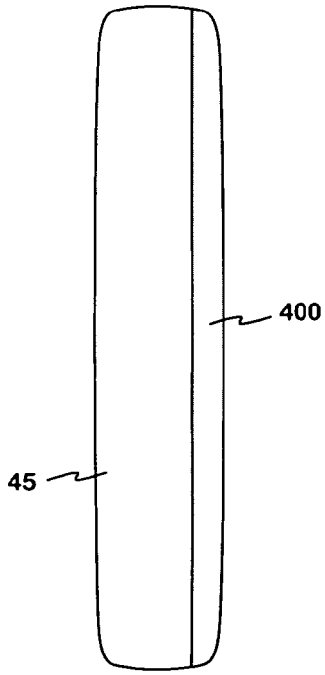

FIGS. 4*a* and 4*b* show a third example of a radiating antenna element according to the invention. An antenna element 400 belongs to a radio device 40 which in this case, too, is an ordinary non-foldable mobile communication device. In FIG. 4*a* the communication device is seen from behind and in FIG. 4*b* from a side. The antenna element 400 is a single conductive piece forming the whole of the back side of the cover of the communication device 40, extending to the lateral sides and end side, too. The radiator is thus in this example particularly large. It connects to the rest 45 of the cover of the radio device without any discontinuity of the outer surface.

Figure 5A:
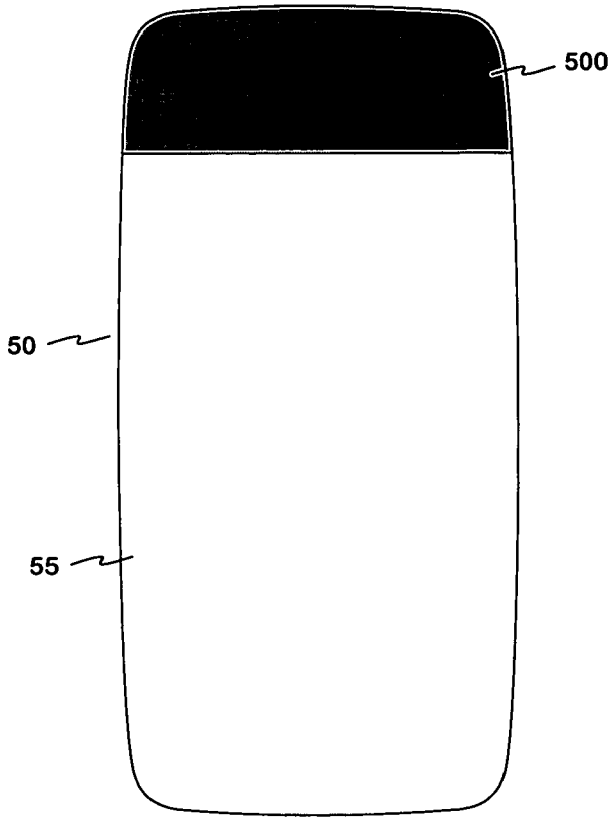
FIGS. 5*a,b* show a fourth example of an antenna element according to the invention.
Figure 5B:
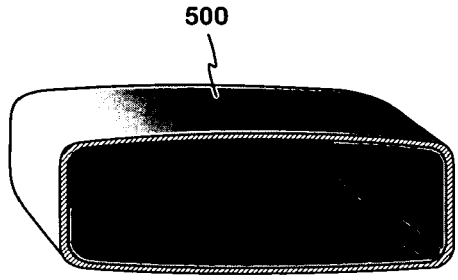

FIGS. 5*a* and 5*b* show a fourth example of a radiating antenna element according to the invention. An antenna element 500 belongs to a radio device 50 which in this case, too, is an ordinary non-foldable mobile communication device. In FIG. 5*a* the communication device is seen from behind and in FIG. 5*b* there is shown just the antenna element 500. This is a single cuplike conductive piece forming the upper portion of the cover of the communication device 50. Thus the radiator 500 will be overlapped only a little when held in hand in the normal manner. The antenna element connects to the rest 55 of the cover of the radio device without any discontinuity of the outer surface.

Figure 6:
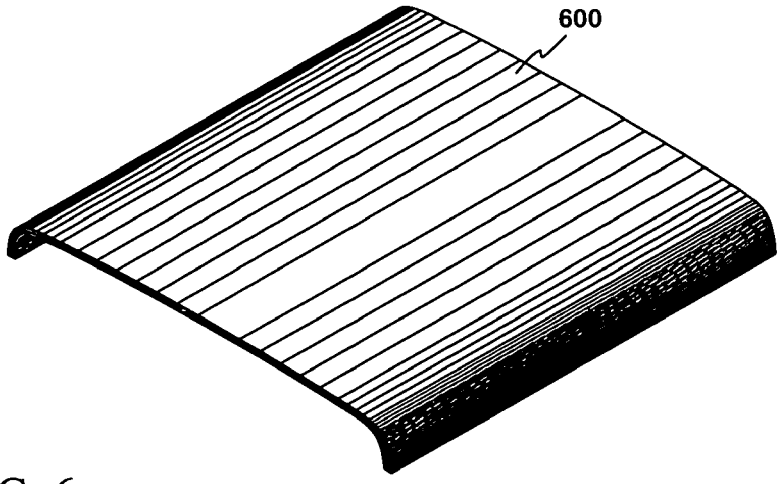
FIG. 6 shows a fifth example of an antenna element according to the invention.

FIG. 6 shows a sixth example of a radiating antenna element according to the invention. An antenna element 600 is now a single trough-like conductive piece constituting an intermediate part of the back side of the cover of a radio device.

Figure 7:
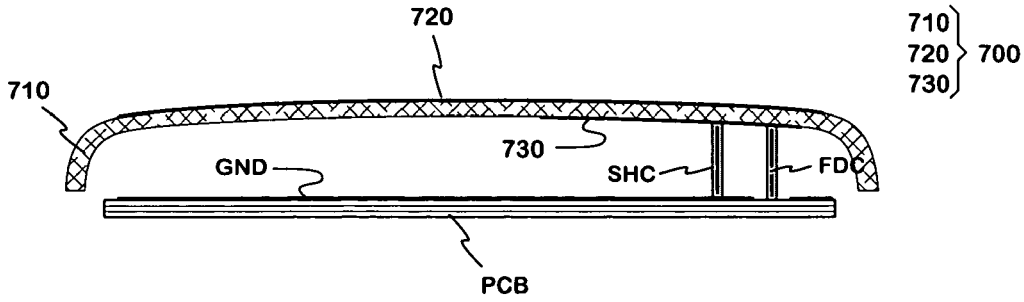
FIG. 7 shows a sixth example of an antenna element according to the invention and an example of its feed.

FIG. 7 shows in cross section a sixth example of an antenna element according to the invention. An antenna element 700 consists now of a dielectric portion 710 in the cover of a radio device, a radiating conductive layer 720 on the outer surface thereof, and a conductive layer on the inner surface thereof, i.e. a feed element 730. The antenna element is fabricated using e.g. IMF (In Mould Foil), IMD (In Mould Decoration) or IML (In Mould Label) technology, so that it is a solid single component.

Below the antenna element 700 there is an antenna ground plane GND provided by the conductive upper surface of the circuit board PCB of the radio device. There is only electromagnetic coupling between the feed element 730 and radiator 720 because the dielectric cover 710 isolates them galvanically from each other. Furthermore, the radiator 720 is not galvanically connected to any other conductive part of the radio device. The feed element 730 is galvanically connected to the antenna port of the radio device by a feed conductor FDC and to the ground plane by a short-circuit conductor SHC. In this example the feed and short-circuit conductors are conductive strips attached to the antenna element, which are pressed against the circuit board PCB by a spring force.

Figure 8:
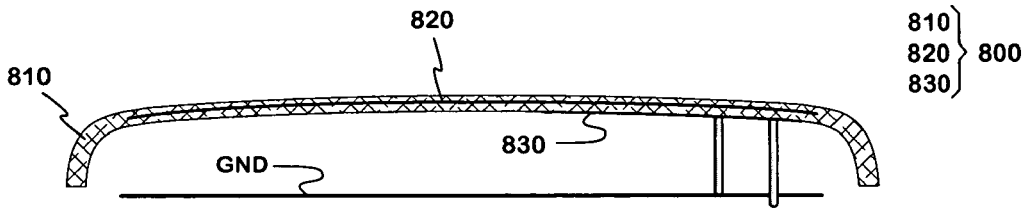
FIG. 8 shows a seventh example of an antenna element according to the invention.

FIG. 8 shows a seventh example of an antenna element according to the invention. An antenna element 800 consists of a dielectric portion 810 of the cover of a radio device, a radiating conductive layer 820 therein, and a conductive layer on the inner surface, i.e. the feed element 830. The difference of this antenna element from the antenna element 700 of FIG. 7 is that the radiator is now within the dielectric cover and not on the outer surface thereof. The antenna element 800 can be fabricated using the same above-mentioned techniques as in fabricating the element 700. Alternatively, in the examples of FIGS. 7 and 8, also the feed element may be embedded within the dielectric portion of the antenna element.

Figure 9:
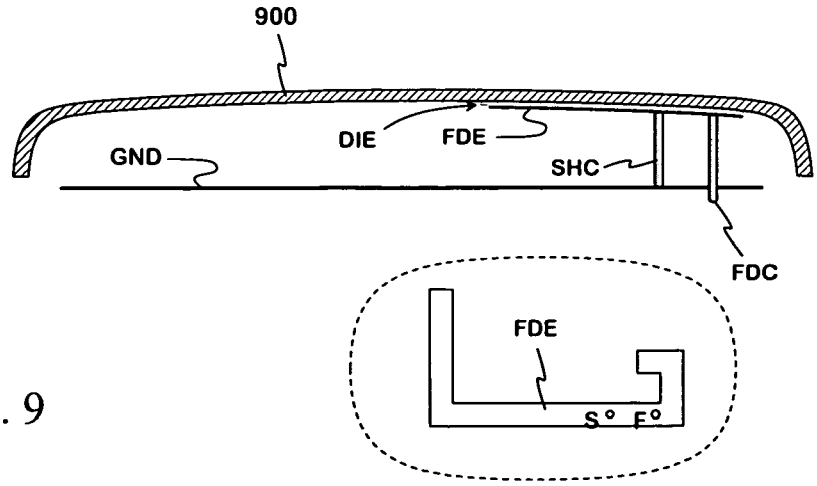
FIG. 9 shows a second example of the feed of an antenna element according to the invention.

FIG. 9 shows a second example of the feed arrangement of an antenna element according to the invention. This figure shows a radiating antenna element 900 which is a single conductive piece. Below the antenna element there is the ground plane GND of the antenna. Between the radiator 900 and ground plane there is a conductive feed element FDE which in this example is galvanically isolated from the radiator by a separate thin dielectric layer DIE. The radiator is not galvanically connected to any conductive part in the radio device. The feed element FDE is galvanically connected to the antenna port of the radio device by a feed conductor FDC and to the ground plane by a short-circuit conductor SHC. Encircled within a broken line there is an example of the shape of the feed element FDE. It is a conductive strip which has two branches of different lengths, viewed from the short-circuit point S, to produce two operating bands for the antenna. The longer branch together with the radiating antenna element and ground plane resonates in the lower operating band area, and the shorter branch together with the radiating antenna element and ground plane resonates in the upper operating band area.

Figure 10:
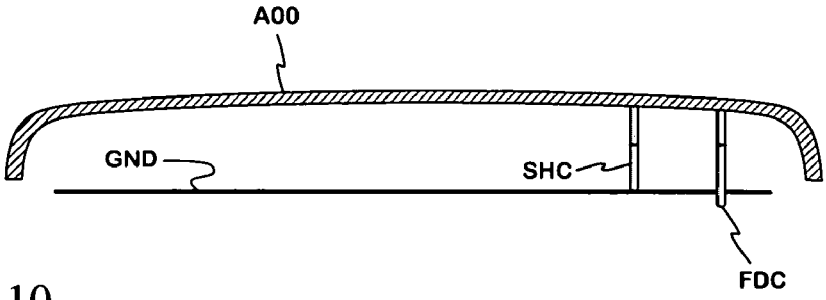
FIG. 10 shows a third example of the feed of an antenna element according to the invention.

FIG. 10 shows in cross section a third example of the feed arrangement of an antenna element according to the invention. In this figure there is shown a radiating antenna element A00 and, below that, the ground plane GND of the antenna. The radiator A00 is now galvanically connected to the antenna port of the radio device by a feed conductor FDC and to the ground plane by a short-circuit conductor SHC. The antenna is thus PIFA type. The feed and short circuit conductors are e.g. so-called pogo pins, in which case their internal springs press the upper parts of the conductors against the radiator. A direct feed to the radiating element according to FIG. 10 requires that, in the element design, not only the desired appearance of the radio device need to be known, but also the electrical dimensions of the element need to be taken into account.

Figure 11:
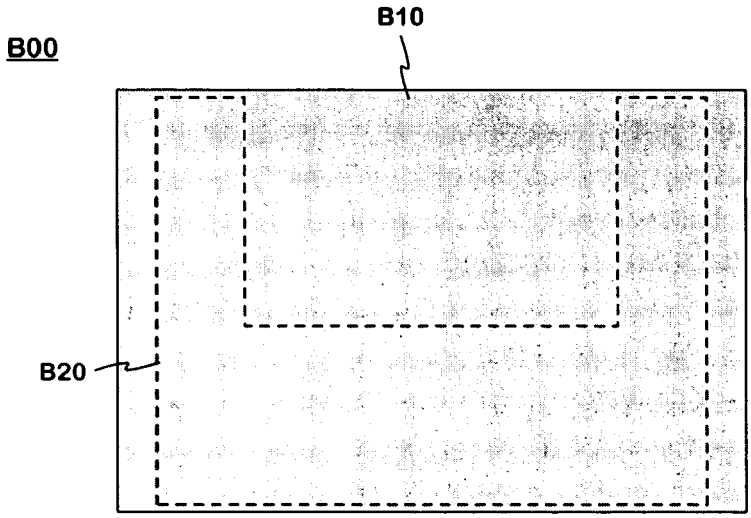
FIG. 11 shows an example of the conductive pattern of an antenna element according to the invention.

The radiating portion of an antenna element according to the invention is advantageously "unbroken", i.e. its border line will not deviate inwards from the, say, rectangular or roundish outline of the element. This is possible especially when using the feed arrangement according to FIGS. 7 to 9. However, in order to enhance the electrical characteristics of the antenna, the radiating portion may be shaped as required. FIG. 11 shows an example of such an antenna element. The element B00 includes a dielectric portion B10 and a radiating portion B20. The radiating portion is inside the dielectric portion and therefore drawn in broken line. The radiating portion has ends extending perpendicularly from its middle region so that a pattern is formed which resembles a wide rectangular U. For example, the radiating portion 720 of the element of FIG. 7 or the radiating portion 820 of the element of FIG. 8 may be shaped like portion B20.

Figure 12:
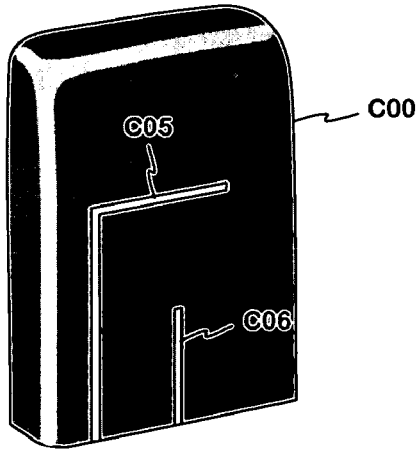
FIG. 12 shows a second example of the conductive pattern of an antenna element according to the invention.

FIG. 12 shows a second example of a shaped radiator. The radiating portion C00 has two non-conductive slots. From the lower edge starts a first slot C05 shaped like letter L and a straight second slot C06. In a complete radio device there is a dielectric protective layer on top of the slots and the whole radiator.

The attributes "lower" and "upper" refer in this description and in the claims to the positions of the antenna element presented in FIGS. 5*a* and 7 to 10 and have nothing to do with the operating positions of the devices.

Antenna elements according to the invention were described above. The shape of an antenna element may differ from those presented, and the invention does not limit the fabricating method of the element. The inventional idea can be applied in different ways within the scope defined by the independent claim 1.

The invention claimed is:

1. A radiating antenna element of a radio device, wherein the element is part of a cover of the radio device, the element having a size which is substantially greater than a quarter of a wavelength corresponding to an operating frequency, wherein said size is independent of, and unbounded by, the wavelength.

2. The antenna element according to claim 1, further including a radiating portion that is galvanically isolated from conductive parts of the radio device.

3. The antenna element according to claim 2, wherein the radiating portion is arranged to be fed electromagnetically by a feed element.

4. The antenna element according to claim 1, wherein the radio device is foldable comprising two folding parts, and the element comprises a rear part of a cover of one of said folding parts.

5. The antenna element according to claim 1, wherein the element comprises an upper portion of a rear part of the cover of the radio device.

6. The antenna element according to claim 1, wherein the element comprises an entire rear part of the cover of the radio device.

7. The antenna element according to claim 1, wherein the element comprises an intermediate portion of a rear part of the cover of the radio device.

8. The antenna element according to claim 1, wherein the element comprises an upper portion of the cover of the radio device.

9. The antenna element according to claim 1, wherein the element is a rigid conductive piece, which forms said part of the radio device substantially entirely.

10. The antenna element according to claim 1, further including a dielectric portion having an outer surface and a radiating portion, which portions together constitute a single integral component.

11. The antenna element according to claim 10, wherein the radiating portion is located on the outer surface of the dielectric portion.

12. The antenna element according to claim 10, wherein the radiating portion is located within the dielectric portion.

13. The antenna element according to claim 10, further comprising an antenna feed element which is also a constituent of the single integral component.

14. The antenna element according to claim 13, wherein the dielectric portion further includes an inner surface, and the feed element is located on the inner surface of the dielectric portion.

15. The antenna element according to claim 13, wherein the feed element is located within the dielectric portion.

16. The antenna element according to claim 1, further including a radiating portion shaped to match the antenna element.

17. A radio device having a cover and a radiating antenna element which is part of the cover, the element having a size which is substantially greater than a quarter of the wavelength corresponding to an operating frequency, wherein said size is independent of, and unbounded by, the wavelength.

* * * * *

UNITED STATES PATENT AND TRADEMARK OFFICE

CERTIFICATE OF CORRECTION

PATENT NO. : 7,391,378 B2
APPLICATION NO. : 10/753887
DATED : June 24, 2008
INVENTOR(S) : Jyrki Mikkola et al.

It is certified that error appears in the above-identified patent and that said Letters Patent is hereby corrected as shown below:

On the Title Page, Item (73)

Please delete "FILTRONIC LK OY and LK PRODUCTS OY".

Signed and Sealed this

Twenty-fifth Day of November, 2008

JON W. DUDAS
*Director of the United States Patent and Trademark Office*